US009221255B2

(12) United States Patent
Yokoyama et al.

(10) Patent No.: US 9,221,255 B2
(45) **Date of Patent: *Dec. 29, 2015**

(54) INK JET HEAD AND INK JET PRINTING APPARATUS HAVING THE SAME

(71) Applicant: TOSHIBA TEC KABUSHIKI KAISHA, Tokyo (JP)

(72) Inventors: Shuhei Yokoyama, Shizuoka (JP); Ryutaro Kusunoki, Shizuoka (JP); Ryuichi Arai, Shizuoka (JP); Masayuki Satomi, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/201,185

(22) Filed: Mar. 7, 2014

(65) Prior Publication Data

US 2014/0253639 A1 Sep. 11, 2014

(30) Foreign Application Priority Data

Mar. 8, 2013 (JP) ..... 2013-047222

(51) Int. Cl.
*B41J 2/045* (2006.01)
*B41J 2/14* (2006.01)

(52) U.S. Cl.
CPC ..... *B41J 2/14233* (2013.01); *B41J 2002/1425* (2013.01); *B41J 2002/14491* (2013.01); *B41J 2202/11* (2013.01)

(58) Field of Classification Search
None
See application file for complete search history.

(56) References Cited

U.S. PATENT DOCUMENTS

| | | | | |
|---|---|---|---|---|
| 7,378,030 | B2 | 5/2008 | Truninger et al. | |
| 2006/0176338 | A1* | 8/2006 | Deguchi et al. | 347/43 |
| 2009/0315965 | A1* | 12/2009 | Yamagata et al. | 347/130 |
| 2010/0149253 | A1* | 6/2010 | Kusunoki | 347/33 |
| 2011/0037813 | A1* | 2/2011 | Nakatani | 347/70 |
| 2011/0164097 | A1* | 7/2011 | Nawano et al. | 347/71 |
| 2012/0056947 | A1* | 3/2012 | Tanuma et al. | 347/71 |
| 2013/0063522 | A1 | 3/2013 | Arai et al. | |
| 2013/0070027 | A1 | 3/2013 | Arai et al. | |
| 2013/0070030 | A1 | 3/2013 | Kusunoki et al. | |
| 2013/0222481 | A1 | 8/2013 | Yokoyama et al. | |
| 2013/0222484 | A1 | 8/2013 | Yokoyama et al. | |

(Continued)

FOREIGN PATENT DOCUMENTS

| | | | |
|---|---|---|---|
| JP | H3-065350 | A | 3/1991 |
| JP | H10-058672 | A | 3/1998 |

(Continued)

OTHER PUBLICATIONS

U.S. Appl. No. 14/024,029, filed on Sep. 11, 2013, 43 pages.
Japanese Office Action with English translation, Patent Application 2013-047222, dated Mar. 24, 2015.

*Primary Examiner* — Erica Lin
(74) *Attorney, Agent, or Firm* — Patterson & Sheridan, LLP

(57) ABSTRACT

An ink jet head includes a pressure chamber formed to hold ink, and a nozzle plate including a vibrating plate forming a bottom wall of the pressure chamber, a driving element that is provided on a surface of the vibrating plate and configured to cause a volume of the pressure chamber to be changed by deforming the vibrating plate upon application of voltage to the driving element, an opening through which the ink held in the pressure chamber is discharged in response to the change of the volume of the pressure chamber, and an insulating layer disposed between the driving element and the opening.

11 Claims, 8 Drawing Sheets

(56) References Cited

U.S. PATENT DOCUMENTS

| | | | |
|---|---|---|---|
| 2013/0271530 | A1 | 10/2013 | Yokoyama et al. |
| 2014/0063095 | A1 | 3/2014 | Yokoyama et al. |

FOREIGN PATENT DOCUMENTS

| | | | |
|---|---|---|---|
| JP | 2011-056939 | A | 3/2011 |
| JP | 2012071587 | A | 4/2012 |

* cited by examiner

INK JET HEAD AND INK JET PRINTING APPARATUS HAVING THE SAME

CROSS-REFERENCE TO RELATED APPLICATION

This application is based upon and claims the benefit of priority from Japanese Patent Application No. 2013-047222, filed Mar. 8, 2013, the entire contents of which are incorporated herein by reference.

FIELD

Embodiments described herein relate generally to an ink jet head and an ink jet printing apparatus having the same.

BACKGROUND

An ink jet printing apparatus forms an image on a medium by discharging ink droplets from nozzles according to an image signal. One type of the ink jet printing apparatus is of a piezoelectric element type. An ink jet printing apparatus of the piezoelectric element type has an ink jet head that includes a nozzle plate having a nozzle and a driving element (actuator) that causes ink to be discharged through the nozzle. When the ink is discharged through the nozzle, the ink passing through the nozzle may contact the driving element of the nozzle plate. By the ink contacting the driving element (e.g., electrodes of the driving elements), the driving element may be damaged and the property of the ink that contacts the driving element may be changed.

DETAILED DESCRIPTION

Figure 1:
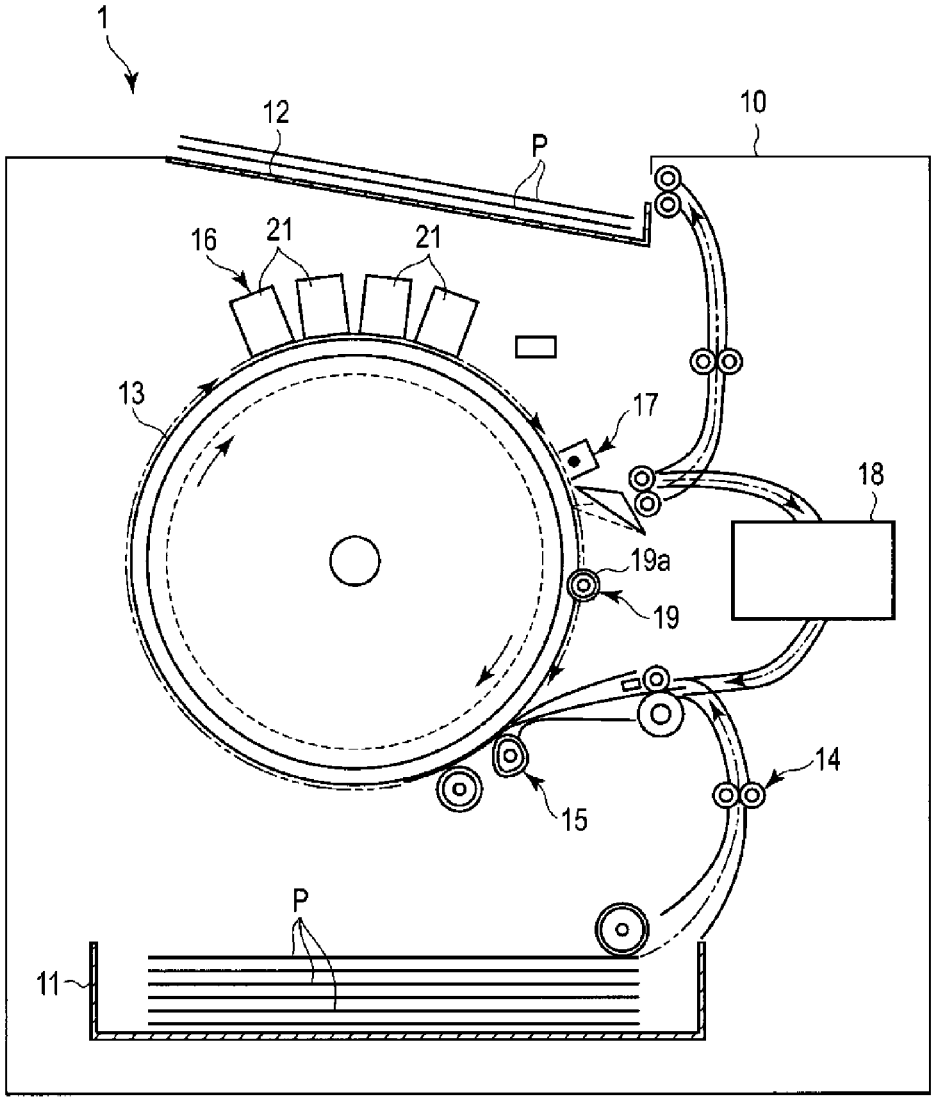
FIG. 1 is a cross-sectional view of an ink jet printer as an example of an ink jet printing apparatus according to a first embodiment.

In general, according to one embodiment, there is provided an ink jet head including a pressure chamber formed to hold ink; and a nozzle plate including a vibrating plate forming a bottom wall of the pressure chamber, a driving element that is provided on a surface of the vibrating plate and configured to cause a volume of the pressure chamber to be changed by deforming the vibrating plate upon application of voltage to the driving element, an opening through which the ink held in the pressure chamber is discharged in response to the change of the volume of the pressure chamber, and an insulating layer disposed between the driving element and the opening.

Hereinafter, a first embodiment will be described with reference to FIGS. 1 to 4. Each element hereinafter may be expressed by one or more expressions. However, this does not deny that an element expressed by one expression may not be expressed in different ways, and does not restrict other ways of expressions that are not shown by way of example. In each of the drawings, an inkjet head and an ink jet printing apparatus according the embodiment is shown schematically, and the dimensional relationship among components shown in the drawings may be different from the dimensional relationship among the components described hereinafter.

FIG. 1 is a cross-sectional view of an ink jet printer 1 according to the first embodiment. The ink jet printer 1 is an example of an ink jet printing apparatus. The ink jet printing apparatus is not limited to the ink jet printer and may be other apparatuses such as a copying machine having a printing function.

The ink jet printer 1 shown in FIG. 1 performs various processes such as image formation while transporting recording paper P which is a recording medium. The ink jet printer 1 includes a housing 10, a paper feeding cassette 11, a paper discharging tray 12, a holding roller (drum) 13, a transporting device 14, a holding device 15, an image forming device 16, a static eliminating and separating device 17, a reversing device 18, and a cleaning device 19.

The paper feeding cassette 11 stores plural sheets of recording paper P and is disposed in the housing 10. The paper discharging tray 12 is disposed in the upper portion of the housing 10. The recording paper P on which an image is formed by the ink jet printer 1 is discharged to the paper discharging tray 12.

The transporting device 14 includes plural guides and plural transporting rollers arranged along a path through which the recording paper P is transported. Since the transporting roller is driven to rotate by a motor, the recording paper P is transported from the paper feeding cassette 11 to the paper discharging tray 12.

The holding roller 13 includes a cylindrical frame formed of a conductor, and a thin insulating layer formed on the surface of the frame. The frame is grounded (ground-connected). The holding roller 13 rotates to transport the recording paper P while holding the recording paper P on the surface thereof.

The holding device 15 causes the recording paper P transported by the transporting device 14 from the paper feeding cassette 11 to be held on the holding roller 13 by making the paper adhere to the surface (outer peripheral surface) of the holding roller 13. The holding device 15 presses the recording paper P against the holding roller 13, and then, makes the recording paper P adhere to the holding roller 13 due to electrostatic force.

The image forming device 16 forms an image on the recording paper P held on the outer surface of the holding roller 13 by the function of the holding device 15. The image forming device 16 includes plural ink jet heads 21 facing the surface of the holding roller 13. The plural ink jet heads 21 respectively discharge four colors of inks of cyan, magenta, yellow, and black onto the recording paper P to form an image.

The neutralizing and separating device 17 electrically neutralizes the recording paper P on which the image is formed to separate the paper P from the holding roller 13. The neutralizing and separating device 17 supplies an electrical charge to neutralize the recording paper P and a claw is set between the recording paper P and the holding roller 13. Accordingly, the recording paper P is separated from the holding roller 13. The recording paper P separated from the holding roller 13 is transported to the paper discharging tray 12 or the reversing device 18 by the transporting device 14.

The cleaning device 19 cleans the holding roller 13. The cleaning device 19 is disposed downstream with respect to the separating device 17 in a rotational direction of the holding roller 13. The cleaning device 19 brings a cleaning member 19*a* into contact with the surface of the rotating holding roller 13 to clean the surface of the rotating holding roller 13.

The reversing device 18 reverses the front and rear surfaces of the recording paper P separated from the holding roller 13 to supply the recording paper P to the surface of the holding roller 13 again. For example, the reversing device 18 reverses the side of the recording paper P by transporting the recording paper P along a predetermined reversing path through which the recording paper P is conveyed back.

Figure 2:
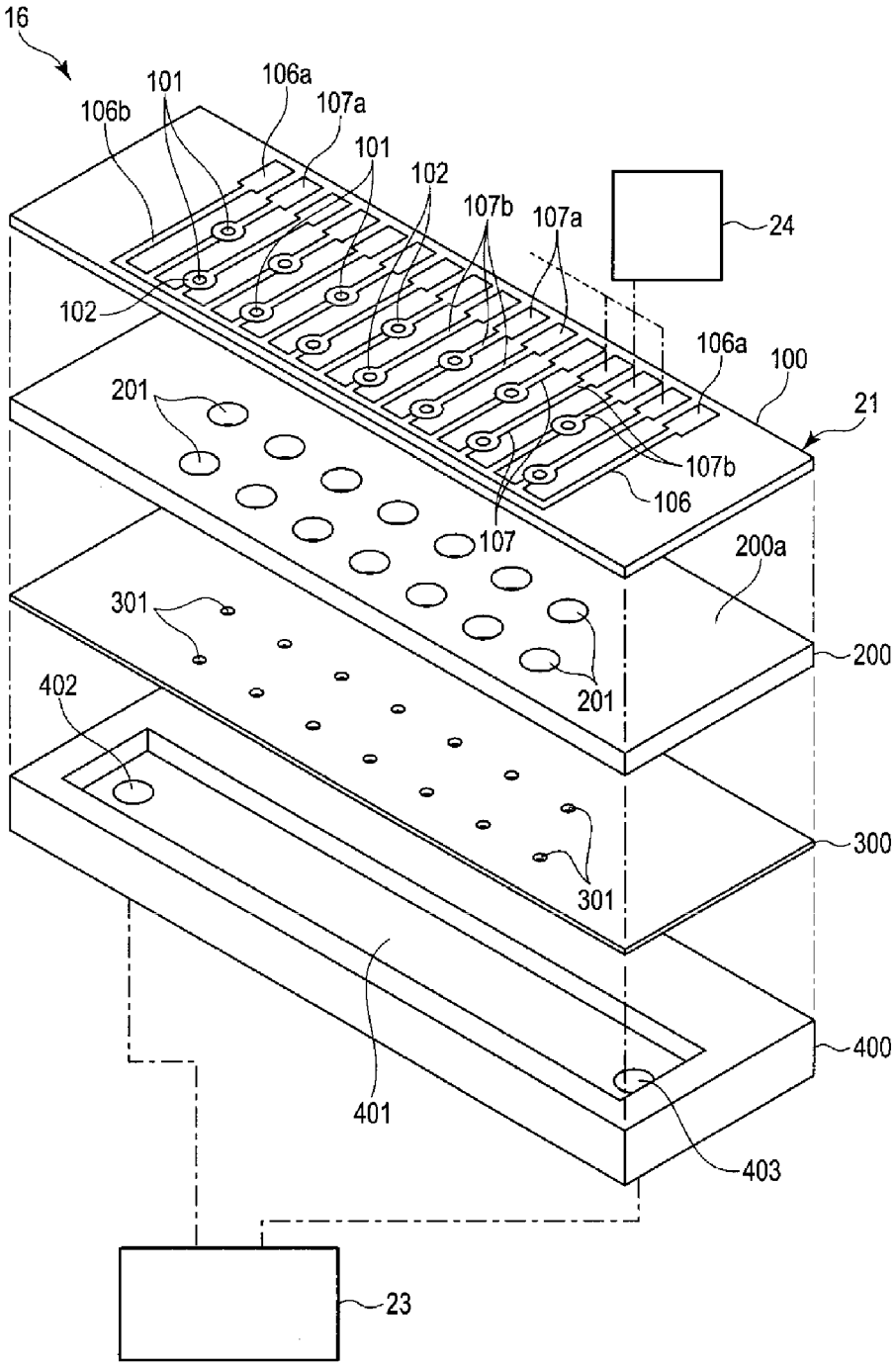
FIG. 2 is an exploded view of an ink jet head of the ink jet printing apparatus according to the first embodiment.
Figure 3:
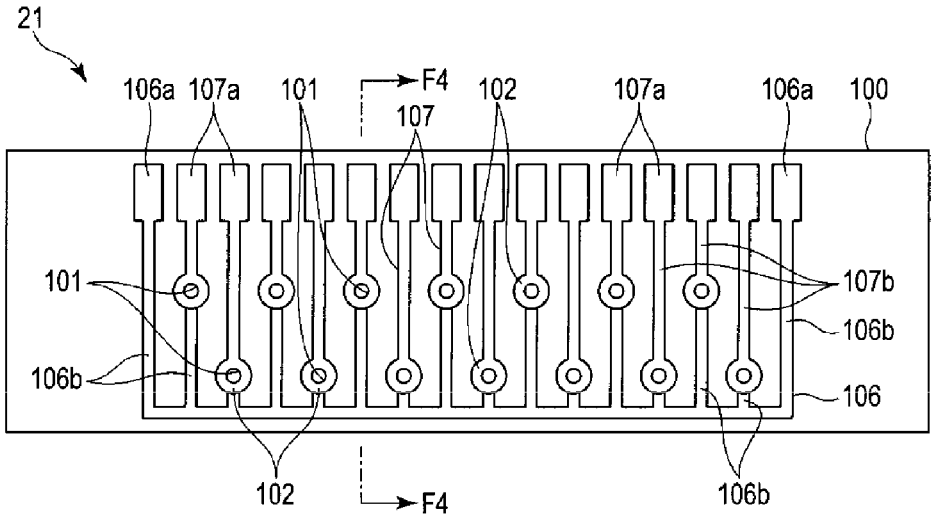
FIG. 3 is a plan view of the ink jet head according to the first embodiment.
Figure 4:
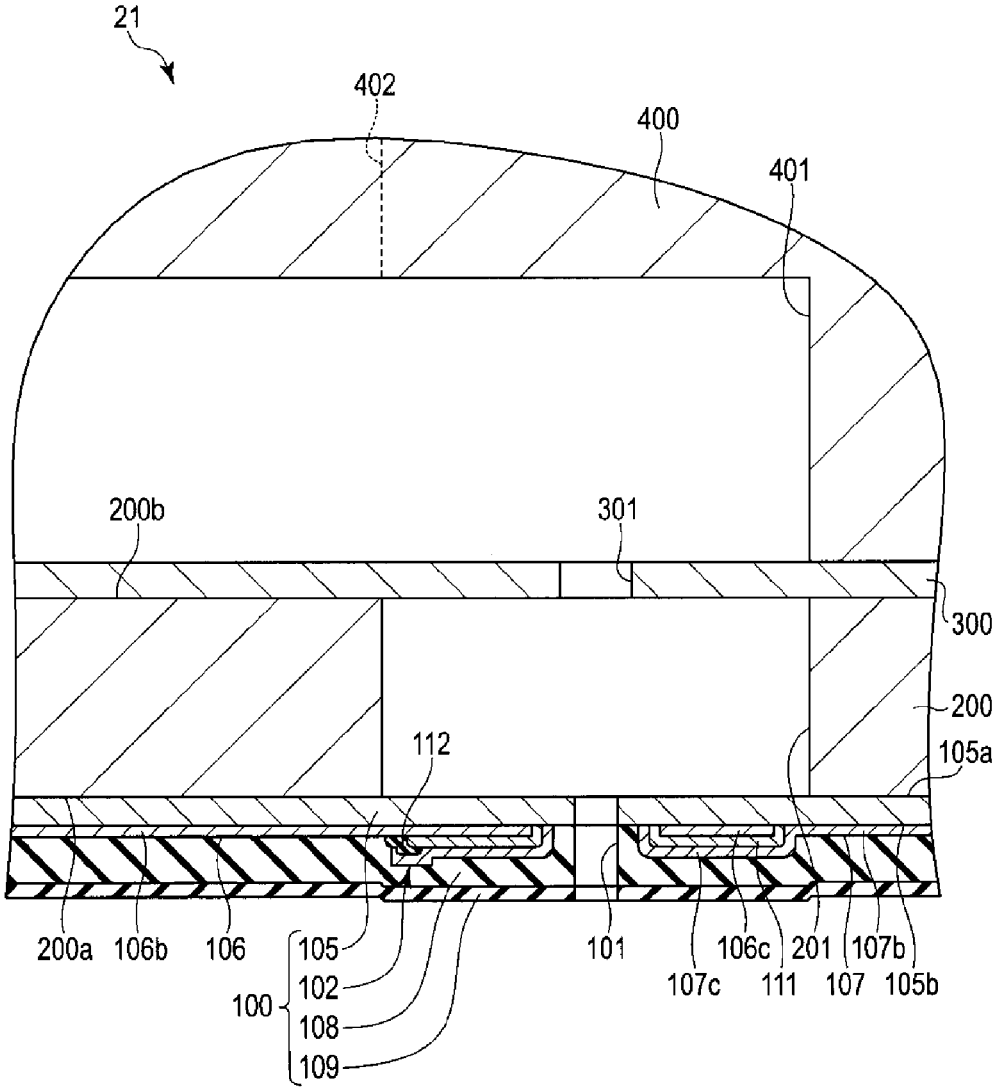
FIG. 4 is a cross-sectional view of a part of the ink jet head according to the first embodiment.

FIG. 2 is an exploded perspective view of an ink jet head 21 included in the image forming device 16. FIG. 3 is a plan view of the inkjet head 21. FIG. 4 is a cross-sectional view of a part of the ink jet head 21 taken along the line F4-F4 of FIG. 3. In FIGS. 2 and 3, various elements which are originally hidden are indicated by solid lines for the sake of description.

As shown in FIG. 2, the ink jet printer 1 includes an ink tank 23 and a controller 24 with respect to each of the plural ink jet heads 21. Each of the ink jet heads 21 is connected to the corresponding ink tank 23 which stores corresponding color ink.

The ink jet head 21 discharges ink droplets to the recording paper P held by the holding roller 13 to form letters or images. The ink jet head 21 includes a nozzle plate 100, a pressure chamber structure 200, a separate plate 300, and an ink channel structure 400. The pressure chamber structure 200 is an example of a substrate.

The nozzle plate 100 is formed in a rectangular shape. The nozzle plate 100 includes plural nozzles (orifices, ink discharging holes) 101, and plural driving elements (actuators) 102.

The plural nozzles 101 are formed of circular holes, and an example of an opening. The diameter of the nozzle 101 is, for example, 20 μm. The nozzles 101 are arranged along two rows extending along a longitudinal direction of the nozzle plate 100. The nozzles 101 arranged in one row and those in the other row are alternately arranged in the longitudinal direction of the nozzle plate 100. That is, the plural nozzles 101 are staggered (alternately). Therefore, the plural driving elements 102 are arranged at a higher density.

In the longitudinal direction of the nozzle plate 100, a distance between centers of adjacent nozzles 101 is, for example, 340 μm. In a short direction of the nozzle plate 100, a distance between the two rows is, for example, 240 μm.

The plural driving elements 102 are arranged corresponding to the plural nozzles 101. In other words, the driving element 102 and the corresponding nozzle 101 are disposed on the same axis. The driving element 102 is formed in an annular shape to surround the corresponding nozzle 101. The driving element 102 is not limited thereto and, for example, may be formed in a partially opened annular shape (C shape) or may be formed in a circular shape to be adjacent to the corresponding nozzle 101.

The pressure chamber structure 200 is formed in a rectangular plate-like shape and formed of a silicon wafer. The pressure chamber structure 200 is not limited thereto, and, for example, other semiconductors such as a silicon carbide (SiC) germanium substrate may be used. In addition, the substrate is not limited thereto and materials other than the semiconductor may be used. The thickness of the pressure chamber structure 200 is, for example, 525 μm.

As shown in FIG. 4, the pressure chamber structure 200 includes a first surface 200*a*, a second surface 200*b*, and plural pressure chambers (ink chambers) 201. The first and second surfaces 200*a* and 200*b* are flattened. The second surface 200*b* is opposite to the first surface 200*a*. The nozzle plate 100 is fixed to the first surface 200*a*.

The plural pressure chambers 201 are formed of circular holes. The diameter of the pressure chamber 201 is, for example, 240 μm. The shape of the pressure chamber 201 is not limited to the circular shape. The pressure chambers 201 penetrate the pressure chamber structure 200 in the thickness direction thereof between the first and second surfaces 200*a* and 200*b*. The openings of the plural pressure chambers 201 in the first surface 200*a* are covered by the nozzle plate 100.

The plural pressure chambers 201 are disposed corresponding to the plural nozzles 101. In other words, the pressure chamber 201 and the corresponding nozzle 101 are disposed on the same axis. Therefore, the corresponding nozzle 101 communicates with the pressure chamber 201. The pressure chamber 201 is connected to the outside of the ink jet head 21 through the nozzle 101.

The separate plate 300 is formed in, for example, a rectangular plate-like shape and formed of stainless steel. The thickness of the separate plate 300 is, for example, 200 μm. The separate plate 300 is attached to the second surface 200*b* of the pressure chamber structure 200 with, for example, an epoxy-based adhesive. Therefore, the openings of the pressure chambers 201 in the second surface 200*b* are covered by the separate plate 300.

The separate plate 300 includes plural ink throttles 301. The ink throttles 301 are formed in a circular shape. The diameter of the ink throttle 301 is, for example, 50 μm. The diameter of the ink throttle 301 is equal to or smaller than one-fourth of the diameter of the pressure chamber 201.

The ink throttles 301 are arranged corresponding to the plural pressure chambers 201. In other words, the ink throttle 301 and the corresponding pressure chamber 201 are disposed on the same axis. Therefore, the corresponding ink throttle 301 is connected to the pressure chamber 201.

The ink channel structure 400 is formed in, for example, a rectangular plate-like shape and formed of stainless steel. The thickness of the ink channel structure 400 is, for example, 4 mm. The materials of the ink channel structure 400 and the above-described separate plate 300 are not limited to stainless steel. For example, other materials such as ceramics or resin may be used. As the ceramics, for example, alumina ceramics, zirconia, silicon carbide, nitrides such as silicon nitride, and oxides may be used. As the resin, for example, plastic materials such as acrylonitrile butadiene styrene (ABS), polyacetal, polyamide, polycarbonate, and polyether sulfone may be used. The materials of the separate plate 300 and the ink channel structure 400 are selected in consideration of differences between expansion coefficients of the materials and the expansion coefficient of the nozzle plate 100 so that the materials do not affect the generation of pressure for discharging ink.

The ink channel structure 400 is attached to the separate plate 300 with, for example, an epoxy-based adhesive. The separate plate 300 is interposed between the pressure chamber structure 200 and the ink channel structure 400. As shown in FIG. 2, the ink channel structure 400 includes an ink channel 401, an ink supply port 402, and an ink discharge port 403.

The ink channel 401 is formed of a groove which is formed on the surface of the ink channel structure 400 attached to the separate plate 300. The depth of the ink channel 401 is, for example, 2 mm. The ink channel 401 surrounds the plural ink throttles 301. In other words, the plural ink throttles 301 are connected to the ink channel 401.

The ink supply port 402 is disposed at one end of the ink channel 401. The ink supply port 402 is connected to the ink tank 23 through, for example, a tube. The ink tank 23 is connected to the plural pressure chambers 201 through the ink channel 401.

The ink in the ink tank 23 flows into the ink channel 401 through the ink supply port 402. The ink supplied to the ink channel 401 is supplied to the plural pressure chambers 201 through the plural ink throttles 301. Each of the ink throttles 301 is adjusted such that the channel resistance of the ink respectively flowing into the corresponding pressure chamber 201 is approximately at the same level. The ink flowing into the pressure chamber 201 also flows into the nozzle 101, which is connected to the pressure chamber 201. The ink jet printer 1 allows the ink to be held inside the nozzle 101 by maintaining the pressure of the ink at an appropriate negative pressure. The ink is prevented from leaking out from the nozzle 101 and forms a meniscus in the nozzle 101.

The ink discharge port 403 is disposed at the other end of the ink channel 401. The ink discharge port 403 is connected to the ink tank 23 through, for example, a tube. The ink in the ink channel 401 not flowing into the pressure chamber 201 is discharged to the ink tank 23 through the ink discharge port 403. In this manner, the ink is circulated between the ink tank 23 and the ink channel 401. The temperatures of the ink jet head 21 and the ink are retained to be constant by the circulation of the ink and thus, for example, deterioration in the ink due to heat can be prevented.

Next, the nozzle plate 100 will be described in detail. As shown in FIG. 4, the nozzle plate 100 includes the above-described nozzles 101, the driving elements 102, a vibrating plate 105, a common electrode 106, plural wiring electrodes 107, a protective film (insulating film) 108, and an ink repellent film 109. The protective film 108 is an example of an insulating layer.

The vibrating plate 105 is formed in, for example, a rectangular plate-like shape and formed of silicon dioxide ($SiO_2$), on the first surface 200*a* of the pressure chamber structure 200. The vibrating plate 105 is formed of an oxide of a material used for the pressure chamber structure 200, which is a silicon wafer. The thickness of the vibrating plate 105 is, for example, 2 μm. The thickness of the vibrating plate 105 is within a range of about 1 μm to 50 μm.

The vibrating plate 105 has a first surface 105*a* and a second surface 105*b*. The first surface 105*a* is fixed to the pressure chamber structure 200 and covers the plural pressure chambers 201. The second surface 105*b* is opposite to the first surface 105*a*.

The common electrode 106 is formed on the second surface 105*b* of the vibrating plate 105. As shown in FIGS. 3 and 4, the common electrode 106 includes two terminal sections 106*a*, plural wiring sections 106*b*, and plural electrode sections 106*c*. The two terminal sections 106*a* are disposed at one end of the vibrating plate 105 in the short direction, and are arranged at opposite ends of the vibrating plate 105 in the longitudinal direction.

Each of the plural wiring electrodes 107 includes a terminal section 107*a*, a wiring section 107*b*, and an electrode section 107*c*. The terminal sections 107*a* of the plural wiring electrodes 107 are disposed at one end of the vibrating plate 105 in the short direction and are arranged side by side between the two terminal sections 106*a* of the common electrode 106.

The common electrode 106 and the plural wiring electrodes 107 are formed of, for example, a platinum (Pt) thin film. The common electrode 106 and the plural wiring electrodes 107 may be formed of other materials such as nickel (Ni), copper (Cu), aluminum (Al), silver (Ag), titanium (Ti), tungsten (W), molybdenum (Mo), and gold (Au). The thickness of the common electrode 106 and the plural wiring electrodes 107 is both, for example, 0.5 μm. The thickness of the common electrode 106 and the plural wiring electrodes 107 is both within a range of about 0.01 μm to 1 μm. The width of the wiring sections 106*b* and 107*b* of the common electrode 106 and the plural wiring electrodes 107 is both, for example, 80 μm.

As shown in FIG. 4, the driving element 102 is disposed on the second surface 105*b* of the vibrating plate 105. The driving element 102 causes pressure of the ink in the corresponding pressure chamber 201 to be changed so that ink droplets are discharged from the corresponding nozzle 101.

Each of the plural driving elements 102 includes the electrode section 106*c* of the common electrode 106, the electrode section 107*c* of the wiring electrode 107, a piezoelectric film 111, and an insulating film 112. The electrode section 106*c* of the common electrode 106 is also referred to as a lower electrode. The electrode section 107*c* of the wiring electrode 107 is also referred to as an upper electrode.

The electrode section 106*c* of the common electrode 106 is formed in an annular shape so as to surround the nozzle 101. The electrode section 106*c* and the nozzle 101 are disposed on the same axis. The external diameter of the electrode section 106*c* is, for example, 172 μm. The internal diameter of the electrode section 106*c* is, for example, 42 μm.

As shown in FIG. 3, the plural wiring sections 106*b* of the common electrode 106 respectively extend from the electrode sections 106*c* of the corresponding driving elements 102 and the two terminal sections 106*a*. The plural wiring sections 106*b* extend in a direction parallel to the short direction of the nozzle plate 100.

The plural wiring sections 106*b* are gathered on the other end of the nozzle plate 100 in the short direction and include a section extending in the longitudinal direction of the nozzle plate 100. Therefore, the two terminal sections 106*a* and the plural electrode sections 106*c* are connected to each other by the plural wiring sections 106*b*.

As shown in FIG. 4, the piezoelectric film 111 surrounds the nozzle 101 and is formed in a larger annular shape than that of the electrode section 106*c* of the common electrode 106. The piezoelectric film 111 and the nozzle 101 are disposed on the same axis. The piezoelectric film 111 covers the electrode section 106*c* of the common electrode 106. The external diameter of the piezoelectric film 111 is, for example, 176 μm. The internal diameter of the piezoelectric film 111 is, for example, 38 μm.

The piezoelectric film 111 is a lead zirconate titanate (PZT) film, which is formed of a piezoelectric material. The material of the piezoelectric film 111 is not limited thereto, and for example, various piezoelectric materials such as PTO ($PbTiO_3$: lead titanate), PMNT ($Pb(Mg_{1/3}Nb_{2/3})O_3$—$PbTiO_3$), PZNT ($Pb(Zn_{1/3}Nb_{2/3})O_3$—$PbTiO_3$), ZnO, AlN, and the like may be used.

The thickness of the piezoelectric film 111 is, for example, 1 μm. The thickness of the piezoelectric film is determined according to, for example, piezoelectric properties and a dielectric breakdown voltage. The thickness of the piezoelectric film is within a range of about 0.1 μm to 5 μm.

The piezoelectric film 111 generates polarization in the thickness direction thereof. When an electric field in a direction that is the same as the direction of the polarization is applied to the piezoelectric film 111, the piezoelectric film 111 expands or contracts in a direction orthogonal to the electric field direction. In other words, by switching the direction of the electric field the piezoelectric film 111 expands and contracts in a direction orthogonal to the film thickness (in-plane direction).

The electrode section 107*c* of the wiring electrode 107 surrounds the nozzle 101 and is formed in a larger annular shape than that of the piezoelectric film 111. The electrode section 107*c* and the nozzle 101 are disposed on the same axis. The electrode section 107*c* covers the piezoelectric film 111. In other words, the electrode section 107*c* is provided on a discharge side (side toward the outside of the ink jet head 21) of the piezoelectric film 111. The external diameter of the electrode section 107*c* is, for example, 180 μm. The internal diameter of the electrode section 107*c* is, for example, 34 μm. Therefore, the electrode section 107*c* is separated from the nozzle 101.

The piezoelectric film 111 is disposed between the electrode section 106*c* of the common electrode 106 and the electrode section 107*c* of the wiring electrode 107. In other words, the electrode sections 106*c* and 107*c* of the common electrode 106 and the wiring electrode 107 overlap with each other with the piezoelectric film 111 disposed therebetween.

The wiring section 107*b* of the wiring electrode 107 is formed on the second surface 105*b* of the vibrating plate 105. As shown in FIG. 3, the wiring section 107*b* connects the electrode section 107*c* with the terminal section 107*a* in the corresponding driving element 102. The plural wiring sections 107*b* extend in a direction parallel to the short direction of the nozzle plate 100. Some of the wiring sections 107*b* pass between the arranged driving elements 102.

As shown in FIG. 4, the insulating film 112 is partially formed at the outer edge of the piezoelectric film 111. The insulating film 112 is formed of, for example, $SiO_2$. The insulating film 112 may be formed of other materials. The thickness of the insulating film 112 is, for example, 0.2 μm.

The insulating film 112 is disposed between the wiring section 106*b* of the common electrode 106 and the electrode section 107*c* of the wiring electrode 107. In other words, the insulating film 112 electrically separates the common electrode 106 from the wiring electrode 107. Thus, the insulating film 112 prevents electrical connection between the common electrode 106 and the wiring electrode 107.

The protective film 108 is disposed on the second surface 105*b* of the vibrating plate 105. The protective film 108 is formed of, for example, non-photosensitive polyimide or positive photosensitive polyimide. The protective film 108 is not limited thereto and may be formed of other insulating materials such as resin or ceramics. As the resin, for example, plastic materials such as other types of polyimides, acrylonitrile butadiene styrene (ABS), polyacetal, polyamide, polycarbonate, and polyether sulfone may be used. As the ceramics, for example, zirconia, silicon carbide, nitrides such as silicon nitride, and oxides may be used. The thickness of the protective film 108 is within a range of about 1 μm to 50 μm.

The protective film 108 covers the second surface 105*b* of the vibrating plate 105, the driving element 102, the common electrode 106, and the wiring electrode 107. The protective film 108 protects the driving element 102 from, for example, ink or vapor in the air. The protective film 108 has plural holes from which the plural terminal sections 106*a* and 107*a* of the common electrode 106 and the wiring electrode 107 are exposed.

The material of the protective film 108 is greatly different from the material of the vibrating plate 105 in Young's modulus. The Young's modulus of $SiO_2$ that is used for the vibrating plate 105 is 80.6 GPa. On the other hand, the Young's modulus of polyimide that is used for the protective film 108 is 4 GPa. That is, a difference between the Young's modulus of the vibrating plate 105 and the Young's modulus of the protective film 108 is 76.6 GPa.

The ink repellent film 109 covers the protective film 108. The ink repellent film 109 is formed of, for example, a silicone-based liquid repellent material having a liquid repellent property. The ink repellent film 109 may be formed of other materials such as fluorine-containing organic materials. The thickness of the ink repellent film 109 is, for example, 1 μm. The ink repellent film 109 does not cover the protective film 108 formed around the terminal section 106*a* of the common electrode 106 and the terminal section 107*a* of the wiring electrode 107.

The nozzle 101 penetrates the vibrating plate 105, the protective film 108, and the ink repellent film 109. In other words, the nozzle 101 is formed through the vibrating plate 105, the protective film 108, and the ink repellent film 109. Since the vibrating plate 105 and the protective film 108 have low ink-philic properties (lyophilicity), the meniscus of the ink held in the pressure chamber 201 is retained in the nozzle 101. A part of the protective film 108 is disposed between the nozzle 101 and the inner peripheral surface (side wall) of the driving element 102.

As shown in FIG. 2, the controller 24 is connected to the terminal section 107*a* of the wiring electrode 107 through, for example, a flexible cable. The controller 24 is, for example, an IC which is configured to control the ink jet head 21 or a microcomputer which is configured to control the ink jet printer 1. On the other hand, the terminal section 106*a* of the common electrode 106 is connected to, for example, a GND (ground=0V).

The controller 24 transmits signals to drive the corresponding driving elements 102 to the plural wiring electrodes 107. The wiring electrodes 107 are used as individual electrodes to independently operate the plural driving elements 102.

The above-described ink jet head 21 performs, for example, printing (image formation) as follows. A print command signal is input to the controller 24 by an operation of a user. The controller 24 transmits the signals towards the plural driving elements 102 based on the print command signal. In other word, the controller 24 applies a driving voltage to the electrode sections 107*c* of the wiring electrode 107.

When the signal is applied to the electrode section 107*c* of the wiring electrode 107, a voltage difference is generated between the potential of the electrode section 107*c* of the wiring electrode 107 and the potential of the electrode section 106*c* of the common electrode 106. Therefore, an electric field is applied to the piezoelectric film 111 in a direction that is the same as the polarization direction, and the driving element 102 expands or contracts in a direction orthogonal to the electrical field direction.

As shown in FIG. 4, the driving element 102 is disposed between the vibrating plate 105 and the protective film 108. Therefore, when the driving element 102 expands in a direction orthogonal to the electrical field direction, a force for deforming the vibrating plate in a concave shape (apart from the pressure chamber 201) is applied to the vibrating plate 105. In other words, the vibrating plate 105 is bent in a direction in which the volume of the pressure chamber 201 is increased. Contrarily, a force for deforming the protective film in a convex shape (towards the pressure chamber 201) is applied to the protective film 108. In other words, the protective film 108 is bent in a direction in which the volume of the pressure chamber 201 is reduced.

On the other hand, when the driving element 102 contracts in a direction orthogonal to the electric field direction, a force for deforming the vibrating plate in a convex shape (towards the pressure chamber 201) is applied to the vibrating plate 105. In other words, the vibrating plate 105 is bent in a direction in which the volume of the pressure chamber 201 is reduced. In addition, a force for deforming the protective film in a concave shape (apart from the pressure chamber 201) is applied to the protective film 108. In other words, the protective film 108 is bent in a direction in which the volume of the pressure chamber 201 is increased.

The Young's modulus of the polyimide that is used for the protective film 108 is smaller than the Young's modulus of $SiO_2$ that is used for the vibrating plate 105. Therefore, a deformation amount of the protective film 108 is larger than a deformation amount of the vibrating plate 105 with respect to the same force.

When the driving element 102 expands in the direction orthogonal to the electrical field direction, an amount of deformation of the protective film 108 in a convex shape (towards the pressure chamber 201) is increased. Therefore, the nozzle plate 100 is deformed in a convex shape (towards the pressure chamber 201) and the volume of the pressure chamber 201 is reduced.

Contrarily, when the driving element 102 contracts in the direction orthogonal to the electric field direction, an amount of deformation of the protective film 108 in a concave shape (apart from the pressure chamber 201) is increased. Therefore, the nozzle plate 100 is deformed in a concave shape (apart from the pressure chamber 201) and the volume of the pressure chamber 201 is increased.

As described above, the driving element 102 operates in a bending mode. Upon a voltage application, the driving element 102 deforms the vibrating plate 105 and thus, the volume of the pressure chamber 201 is changed.

First, the driving element 102 deforms the vibrating plate 105 and thus, the volume of the pressure chamber 201 is increased. Therefore, negative pressure is generated in the ink held in the pressure chamber 201 and thus, additional ink flows into the pressure chamber 201 from the ink channel 401.

Next, the driving element 102 deforms the vibrating plate 105 and thus, the volume of the pressure chamber 201 is reduced. Accordingly, the ink in the pressure chamber 201 is pressurized. Although positive pressure is applied to the ink in the pressure chamber 201, the ink is not released to the ink channel 401 because the ink throttle 301 obstructs the flow of the ink. Therefore, the pressurized ink is discharged from the nozzle 101.

As the difference between the Young's modulus of the vibrating plate 105 and the Young's modulus of the protective film 108 becomes lager, when the same voltage is applied to the driving element 102, the difference in the deformation amount of the vibrating plate 105 increases. Accordingly, the larger the difference between the Young's modulus of the vibrating plate 105 and the Young's modulus of the protective film 108 is, the smaller the voltage at which ink may be discharged is. Thus, the ink jet head 21 may effectively discharge the ink.

When the Young's modulus and the thickness of the vibrating plate 105 and the protective film 108 are the same, even when a voltage is applied to the driving element 102, forces for deforming the vibrating plate and the protective film in exactly opposite directions by the same deformation amount are applied to the vibrating plate 105 and the protective film 108. Therefore, the vibrating plate 105 is not deformed.

The deformation amount of the plate material is affected by not only the Young's modulus of the material but also the thickness of the plate material. When the same force is applied to the plate material, the smaller the thickness is, the larger the deformation amount of the plate material is. Therefore, when a deformation amount of the vibrating plate 105 and a deformation amount of the protective film 108 are set differently, it may be necessary to consider not only Young's modulus of the plate materials but also thickness of the plate materials. Even when the Young's modulus of the material of the vibrating plate 105 and the Young's modulus of the material of the protective film 108 are the same, when the thicknesses are different, ink discharge is possible, although under a condition in which a high voltage is applied to the driving element 102.

Next, an example of a method for manufacturing the ink jet head 21 will be described. First, an $SiO_2$ film as the vibrating plate 105 is formed over the entire region of the first surface 200*a* of the pressure chamber structure 200 (silicon wafer) before the pressure chamber 201 is formed. The $SiO_2$ film is formed by, for example, a CVD method. The $SiO_2$ film may be formed by not only the CVD method, but also a thermal oxidation method in which a silicon wafer is subjected to a heat treatment in an oxygen atmosphere to form the $SiO_2$ film on the surface of the silicon wafer.

The silicon wafer used for forming the pressure chamber structure 200 is one large disc. The silicon wafer is cut into the plural pressure chamber structures 200 later. The embodiment is not limited thereto and one rectangular silicon wafer may be used to form one pressure chamber structure 200.

Heating and formation of a thin film is repeated on the above-described silicon wafer in a process of manufacturing the inkjet head 21. Therefore, the silicon wafer is preferably a silicon wafer which has heat resistance and is smoothened according to the semiconductor equipment and materials international (SEMI) standard.

Next, a metal film to be formed as the common electrode 106 is formed on the second surface 105*b* of the vibrating plate 105. First, using a sputtering method, a Ti film and a Pt film are sequentially formed. The thickness of the Ti film is, for example, 0.45 μm, and the thickness of the Pt film is, for example, 0.05 μm. The metal film may be formed by other forming method such as deposition and plating.

After the metal film is formed, the common electrode 106 is formed by patterning the metal film. The patterning is performed by forming an etching mask on the metal film and removing the metal film exposed from the etching mask by etching.

Since the nozzle 101 is formed in the center of the electrode section 106*c* of the common electrode 106, a region without the metal film (hole) which is concentric with the center of the electrode section 106*c* is formed. Since the common electrode 106 is patterned, the vibrating plate 105 is exposed in regions that do not overlap the terminal section 106*a*, the wiring section 106*b* and the electrode section 106*c* of the common electrode 106.

Next, the piezoelectric film 111 is formed on the electrode section 106*c* of the common electrode 106. The piezoelectric film 111 is formed by, for example, an RF magnetron sputtering method. At this time, the temperature of the silicon wafer is, for example, 350° C. After the piezoelectric film formation, in order to give piezoelectric properties to the piezoelectric film 111, the piezoelectric film 111 is subject to a heat treatment for three hours at 500° C. Thus, the piezoelectric film 111 can obtain satisfactory piezoelectric properties. The piezoelectric film 111 may be formed by other forming methods such as a chemical vapor deposition (CVD) method, a sol-gel method, an aero-sol deposition method (AD method), and a hydrothermal synthesis method.

Next, the piezoelectric film 111 is patterned by etching. Since the nozzle 101 is formed in the center of the piezoelectric film 111, a region without a piezoelectric film (hole) which is concentric with the piezoelectric film 111 is formed.

The vibrating plate 105 is exposed in the region that does not overlap the piezoelectric film 111. The piezoelectric film 111 covers the electrode section 106*c* of the common electrode 106.

Next, the insulating film 112 is formed on a part of the piezoelectric film 111 and a part of the common electrode 106. The insulating film 112 is formed by a CVD method which may achieve satisfactory insulating properties with low-temperature film formation. The insulating film 112 is formed and then, patterned. The insulating film 112 covers only a part of the piezoelectric film 111 to prevent a potential defect that may be caused by fluctuation in a patterning process. The insulating film 112 covers the piezoelectric film 111 so as not to reduce a deformation amount of the piezoelectric film 111.

Next, a metal film as the wiring electrode 107 is formed on the vibrating plate 105, the piezoelectric film 111, and the insulating film 112. The metal film is formed by, for example, a sputtering method. The metal film may be formed by other forming methods such as vacuum deposition and plating.

The wiring electrode 107 is formed by patterning the metal film. The patterning is performed by forming an etching mask on the metal film and removing the metal film exposed from the etching mask by etching.

Since the nozzle 101 is formed in the center of the electrode section 107*c* of the wiring electrode 107, a region without an electrode film (hole) which is concentric with the center of the electrode section 107*c* of the wiring electrode 107 is formed. The electrode section 107*c* of the wiring electrode 107 covers the piezoelectric film 111.

Next, the $SiO_2$ film as the vibrating plate 105 is patterned to form a part of the nozzle 101. The patterning is performed by forming an etching mask on the $SiO_2$ film and removing the $SiO_2$ film exposed from the etching mask by etching.

The etching mask is formed by applying a photo resist onto the vibrating plate 105, performing pre-baking, exposing the vibrating plate 105 using a mask in which a desired pattern is formed, and performing development and post-baking.

Next, the protective film 108 is formed on the vibrating plate 105 by a spin coating method (spin coat). That is, the protective film 108 is formed on the second surface 105*b* of the vibrating plate 105. First, the vibrating plate 105, the common electrode 106, the wiring electrode 107, and the insulating film 112 are covered by a solution containing a polyimide precursor. Next, while the silicon wafer rotates, the surface of the solution is smoothened. The protective film 108 is formed by performing thermal polymerization and solvent removal by baking. The protective film 108 may be formed by other methods such as CVD, vacuum deposition, and plating.

Next, the nozzle 101 is formed and the terminal section 106*a* of the common electrode 106 and the terminal section 107*a* of the wiring electrode 107 are exposed by patterning the protective film 108. The patterning is performed in a procedure according to the material of the protective film 108.

When the protective film 108 is formed of non-photosensitive polyimide, first, a layer of a solution containing a polyimide precursor is formed on the silicon wafer by a spin coating method, and then thermal polymerization and solvent removal is performed on the formed layer of the solution by baking the layer of the solution. As a result, the non-photosensitive polyimide film is formed. Then, patterning of the non-photosensitive polyimide film is performed by forming an etching mask on the non-photosensitive polyimide film and removing the polyimide film exposed from the etching mask by etching. The etching mask is formed by applying a photo resist onto the non-photosensitive polyimide film, performing pre-baking, exposing the film using a mask in which a desired pattern is formed, and performing development and post-baking.

When the protective film 108 is formed of positive photosensitive polyimide, first, a layer of a solution is formed by a spin coating method, and then the positive photosensitive polyimide film is formed by performing pre-baking. Then, patterning of the positive photosensitive polyimide film is performed by an exposure processing using a mask on which regions corresponding to the nozzle 101, the terminal section 106*a* of the common electrode 106, and the terminal section 107*a* of the wiring electrode 107 are opened (through which light passes), and a development process. Then, post-baking is performed to form the protective film 108.

Next, a cover tape is attached onto the protective film 108. The cover tape is, for example, a back protection tape for chemical mechanical polishing (CMP) for the silicon wafer. The plural pressure chambers 201 are formed in the pressure chamber structure 200 after the pressure chamber structure 200 to which the cover tape is attached is turned over. The pressure chamber 201 is formed by patterning of the pressure chamber structure 200.

For example, an etching mask is formed on the pressure chamber structure 200, which is a silicon wafer, and a so-called vertical deep drilling dry etching, which is preferably applied to a silicon substrate, is performed. Thus, regions of the silicon wafer exposed from the etching mask are removed, and therefore the pressure chamber 201 is formed.

An SF6 gas used in the etching does not have an etching effect on the vibrating plate 105 formed of $SiO_2$ and the protective film 108 formed of polyimide. Therefore, the progress of the dry etching into the silicon wafer is stopped at the vibrating plate 105.

In the above-described etching, various methods such as a wet etching method, in which a chemical is used, and a dry etching method, in which plasma is used, may be employed. Further, the etching method and etching conditions may be changed according to materials. After the etching using the photo resist films completes, the remaining photo resist films are removed by a dissolution solvent.

As described above, the step of forming the driving element 102 and the nozzle 101 on the vibrating plate 105 through the step of forming the pressure chamber 201 in the pressure chamber structure 200 are performed by a film formation technique and a photolithography etching technique. Therefore, the nozzle 101, the driving element 102, and the pressure chamber 201 are accurately and easily formed in the one silicon wafer.

Next, the separate plate 300 and the ink channel structure 400 are attached to the pressure chamber structure 200. That is, the separate plate 300, to which the ink channel structure 400 is attached, is attached to the pressure chamber structure 200 by an epoxy-based adhesive.

A margin of the bonding of the pressure chamber structure 200, the separate plate 300, and the ink channel structure 400 is set to within, for example, about 0.2 mm. Therefore, the bonding is performed easily in a short time.

Next, the cover tape is attached to a part of the protective film 108 so as to cover the terminal section 106*a* of the common electrode 106 and the terminal section 107*a* of the wiring electrode 107. The cover tape is made of resin and may be easily attached to or detached from the protective film 108. The cover tape prevents adhesion of dust and the ink repellent film 109 to the terminal section 106*a* of the common electrode 106 and the terminal section 107*a* of the wiring electrode 107.

Next, the ink repellent film 109 is formed on the protective film 108. The ink repellent film 109 is formed by spin-coating an ink repellent film material in a liquid state on the protective film 108. At this time, positive pressure air is injected from the ink supply port 402. Consequently, the positive pressure air is discharged from the nozzle 101 connected to the ink channel 401. When the ink repellent film material in a liquid state is applied in this state, the ink repellent film material is prevented from adhering to the inner peripheral surface of the nozzle 101. The ink repellent film 109 is formed and then, the cover tape is peeled off from the protective film 108.

Next, the silicon wafer structure is divided into plural ink jet heads 21. The ink jet heads 21 are mounted in the ink jet printer 1. The controller 24 is connected to the terminal sections 107*a* of the wiring electrode 107 through, for example, a flexible cable. Further, the ink supply port 402 and the ink discharge port 403 of the ink channel structure 400 are connected to the ink tank 23 through, for example, tubes.

As described above, in the embodiment, the nozzle plate 100 is formed on the pressure chamber structure 200. However, instead of forming the nozzle plate 100 on the pressure chamber structure 200, a part of the pressure chamber structure 200 may be used as the vibrating plate. For example, the driving element 102 is formed on one surface of the pressure chamber structure 200 and a hole corresponding to the pressure chamber 201 is formed from the other surface. The hole does not penetrate the pressure chamber structure 200, a thin layer remains on one surface of the pressure chamber structure 200. This thin layer can be used as the vibrating plate.

In the ink jet printer 1 according to the first embodiment, the diameter of the nozzle 101 (e.g., 20 μm) is smaller than the internal diameter of the driving element 102 (e.g., 34 μm). Therefore, the insulating protective film 108 is formed between the nozzle 101 and the driving element 102.

As the ink in the nozzle 101 is blocked by the protective film 108, the ink does not contact the driving element 102. Therefore, even when an aqueous ink or an ink containing a conductive material is used in the ink jet printer 1, when a voltage is applied to the driving element 102, electrolysis between the driving element 102 and the ink can be prevented. Accordingly, it is possible to prevent corrosion of the electrode sections 106*c* and 107*c* of the driving element 102 or deterioration of the ink. Various types of ink including a conductive ink may be used in such an ink jet printer 1 and ink jet head 21.

Further, the ink jet head 21 may be accurately and simply manufactured on one substrate such as the silicon wafer using a film formation technique and a photolithography etching technique. Therefore, the ink jet head 21 in which various types of ink may be used may be manufactured at a low cost.

The protection film 108 insulates the driving element 102 and protects the driving element 102 from ink or moisture around it. Thus, it is possible to prevent corrosion of the driving element 102 and deterioration of the ink at a low cost.

Next, a second embodiment will be described with reference to FIG. 5. Regarding plural embodiments disclosed below, the same reference numerals refer to components having the same functions as those of the inkjet printer 1 according to the first embodiment. Further, the descriptions of the components will be partially or completely omitted.

Figure 5:
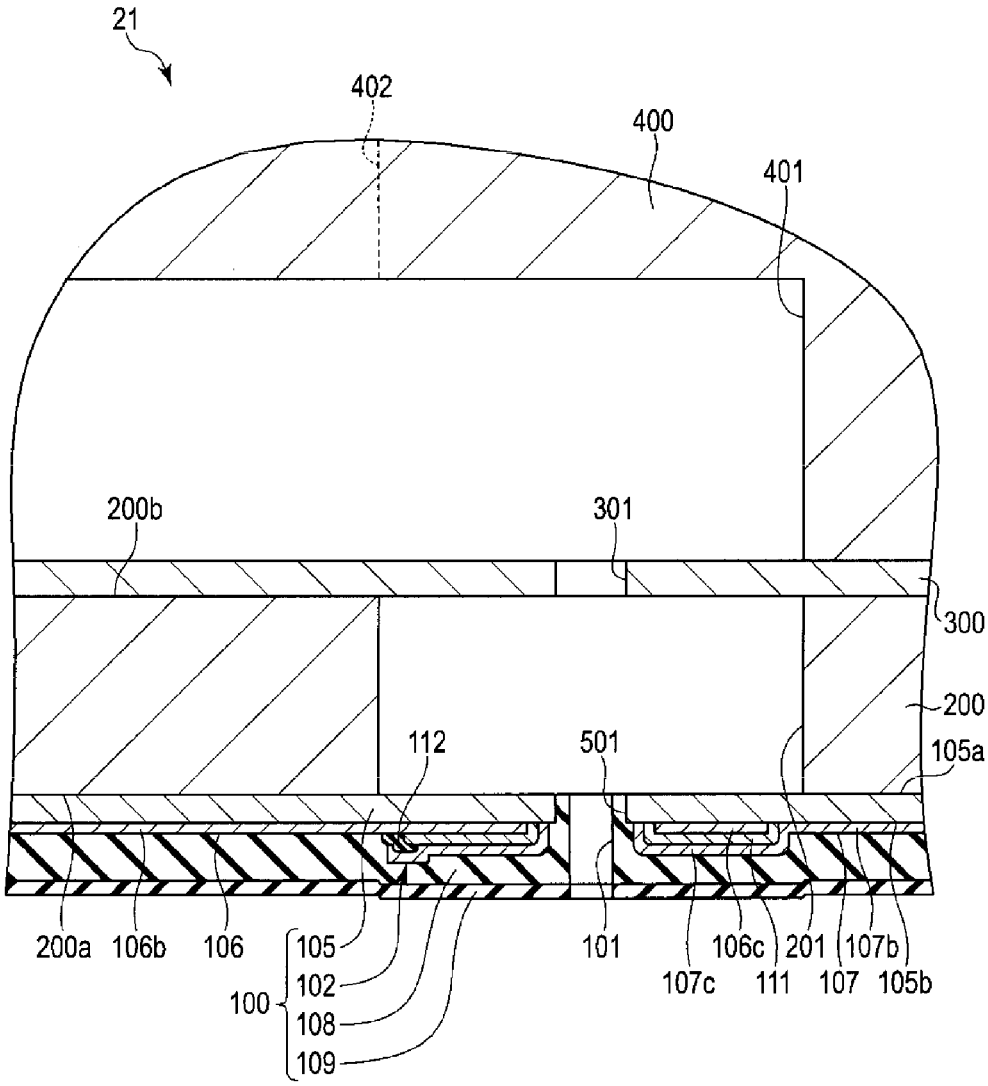
FIG. 5 is a cross-sectional view of a part of an inkjet head according to a second embodiment.

FIG. 5 is a cross-sectional view of a part of the ink jet head 21 according to the second embodiment. While the nozzle 101 in the first embodiment is formed with the side walls of the vibrating plate 105 and the protective film 108, the nozzle 101 in the second embodiment is not formed with the side wall of the vibrating plate 105 but by the side wall of the protective film 108 formed on the side wall of the vibrating plate 105.

The vibrating plate 105 has plural peripheral holes 501. The plural peripheral holes 501 are formed corresponding to the plural nozzles 101. In other words, the peripheral hole 501 and the corresponding nozzle 101 are disposed on the same axis.

Each of the peripheral holes 501 is a circular hole. The diameter of the peripheral hole 501 is, for example, 26 μm. The diameter of the peripheral hole 501 is larger than the diameter of the nozzle 101 (e.g., 20 μm). The inner peripheral surface (side wall) of the peripheral hole 501 is covered by the protective film 108. That is, the nozzle 101 is formed of the protective film 108 provided inside the peripheral hole 501.

In the ink jet head 21 according to the second embodiment, the nozzle 101 is not formed with the side wall of the vibrating plate 105 but with the protective film 108. Accordingly, the shape of the nozzle 101 can be more uniform. That is, a surface of the nozzle 101 formed in the vibrating plate 105 and a surface of the nozzle 101 formed in the protective film 108 can be continuous and smooth, so that non-uniform shapes are not formed. Thus, uniformity of the surface of the nozzle 101 is improved, and therefore accuracy of landing positions of ink droplets discharged from the plural nozzles 101 is improved.

Figure 6:
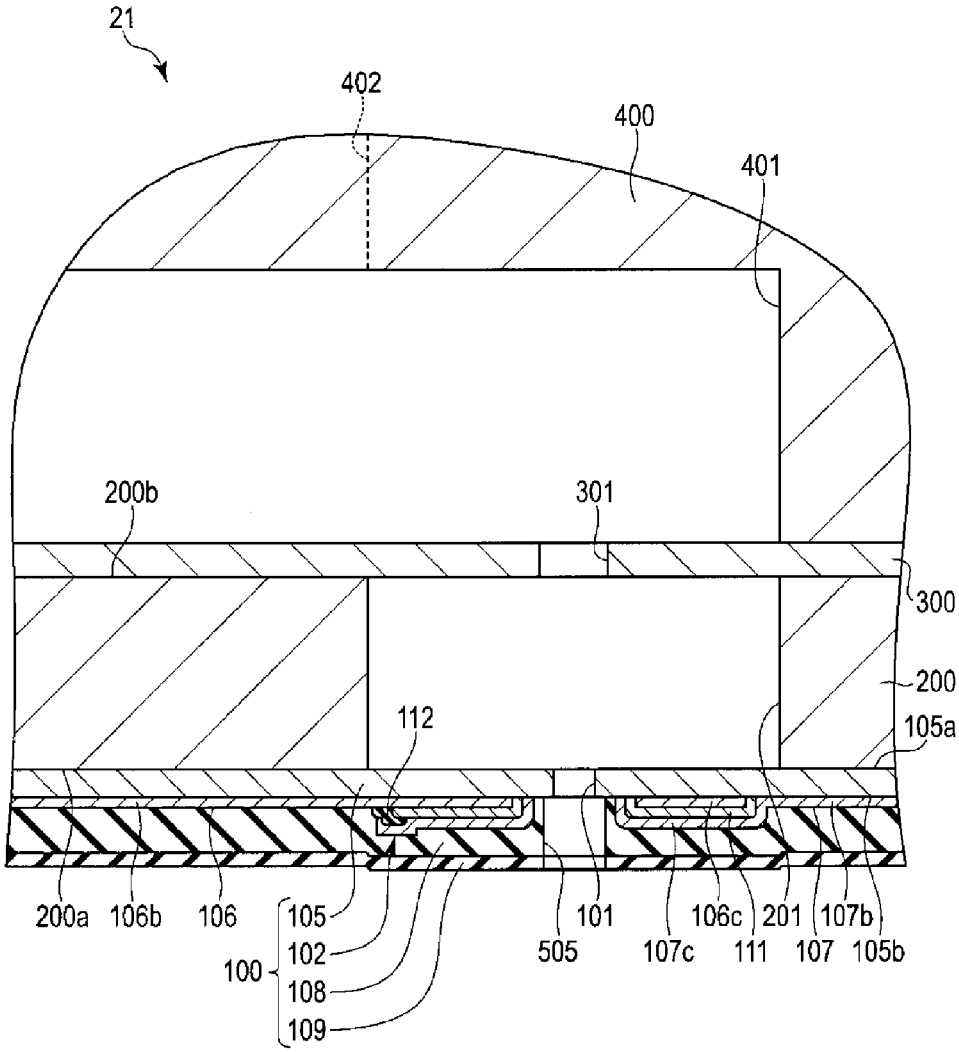
FIG. 6 is a cross-sectional view of a part of an inkjet head according to a third embodiment.

Next, a third embodiment will be described with reference to FIG. 6. FIG. 6 is a cross-sectional view of a part of the ink jet head 21 according to the third embodiment. While the nozzle 101 in the first embodiment is formed with the side walls of the vibrating plate 105 and the protective film 108, the nozzle 101 in the third embodiment is not formed with the side wall of the protective film 108 but with the side wall of the vibrating plate 105.

The protective film 108 has plural openings 505. The plural openings 505 are formed corresponding to the plural nozzles 101. In other words, the opening 505 and the corresponding nozzle 101 are disposed on the same axis.

Each of the openings 505 is formed of a circular hole. The diameter of the opening 505 is larger than the diameter of the nozzle 101. The inner peripheral surface of the opening 505 is recessed from the side wall of the nozzle 101. The ink droplets discharged from the nozzle 101 pass through the inside of the opening 505, but do not contact the inner peripheral surface of the opening 505.

On the other hand, the diameter of the opening 505 is smaller than the internal diameter of the electrode section 107*c* of the wiring electrode 107. Therefore, a part of the protective film 108 is formed between the opening 505 and the driving element 102. The inner peripheral surface of the opening 505 may be covered by the ink repellent film 109.

In the ink jet head 21 according to the third embodiment, the nozzle 101 is not formed with the side wall of the protective film 108 but with the side wall of the vibrating plate 105. As the surface of the nozzle 101 is formed with the side wall of a single layer, the shape of the nozzle 101 can be uniform. Thus, uniformity in the surface of the nozzle 101 is improved, and therefore accuracy of landing positions of ink droplets discharged from the plural nozzles 101 is improved.

Figure 7:
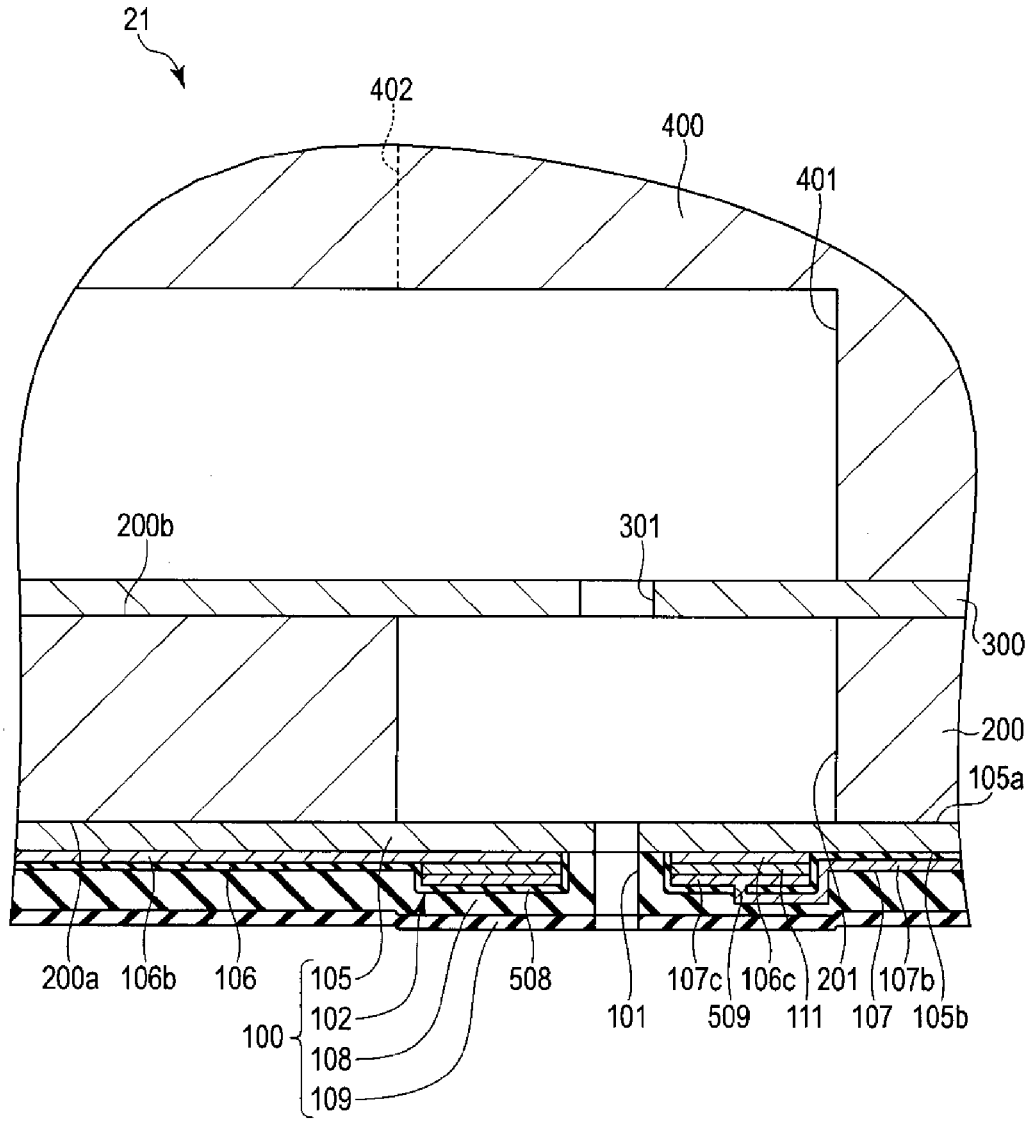
FIG. 7 is a cross-sectional view of a part of an inkjet head according to a fourth embodiment.

Next, a fourth embodiment will be described with reference to FIG. 7. FIG. 7 is a cross-sectional view of a part of the ink jet head 21 according to the fourth embodiment. As shown in FIG. 7, the electrode section 106*c* of the common electrode 106, the electrode section 107*c* of the wiring electrode 107, and the piezoelectric film 111 are formed so as to have approximately the same size.

The ink jet head 21 includes an insulating layer (insulating film) 508. The insulating layer 508 is an example of an insulating layer similarly to the protective film 108. The insulating layer 508 is formed of, for example, $SiO_2$. The insulating layer 508 covers a part of the second surface 105*b* of the vibrating plate 105, the wiring section 106*b* and the electrode section 106*c* of the common electrode 106, the electrode section 107*c* of the wiring electrode 107, and the piezoelectric film 111. The insulating layer 508 covers the inner peripheral surface of the driving element 102. Therefore, the protective film 108 and the insulating layer 508 are disposed between the nozzle 101 and the driving element 102. The insulating layer 508 has plural holes from which the terminal section 106*a* of the common electrode 106 is exposed.

The insulating layer 508 includes a contact section 509. The contact section 509 is a hole formed in the insulating layer 508. The electrode section 107*c* of the wiring electrode 107 is exposed from the contact section 509. The wiring section 107*b* of the wiring electrode 107 is connected to the electrode section 107*c* through the contact section 509. The wiring section 107*b* may be also referred to as an extraction electrode. The terminal section 107*a* and the wiring section 107*b* of the wiring electrode 107 are formed on the insulating layer 508.

In the ink jet printer 1 according to the fourth embodiment, the protective film 108 and the insulating layer 508 are formed between the nozzle 101 and the driving element 102. Therefore, the driving element 102 is more reliably insulated. Accordingly, corrosion of the driving element 102 and deterioration of the ink can be more reliably prevented.

Figure 8:
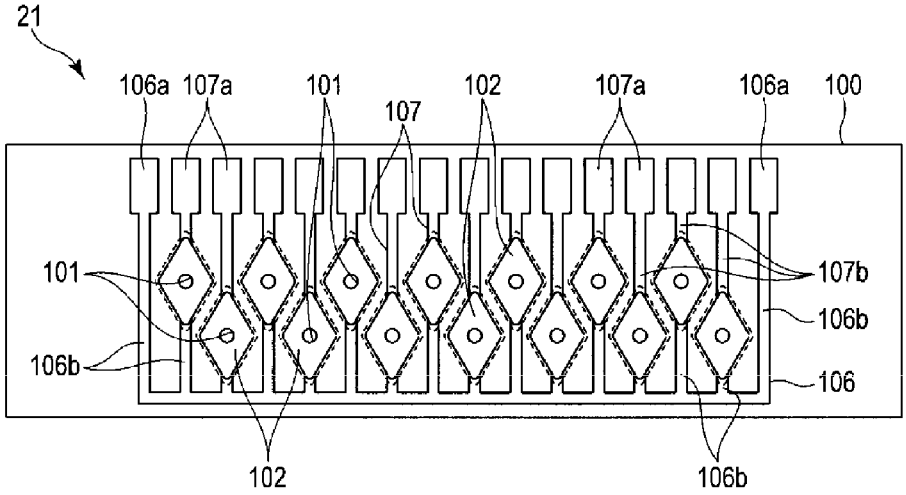
FIG. 8 is a plan view of an ink jet head according to a fifth embodiment.

Next, a fifth embodiment will be described with reference to FIG. 8. FIG. 8 is a plan view of the ink jet head 21 according to the fifth embodiment. The driving element 102 in the fifth embodiment is different from the driving element 102 in the first embodiment in shape.

As shown in FIG. 8, the driving element 102 in the fifth embodiment has a diamond shape. The width of the driving element 102 is, for example, 170 μm, and the length is, for example, 340 μm. The nozzle 101 is disposed in the center of the driving element 102. The pressure chamber 201 also has a diamond shape corresponding to the shape of driving element 102.

The driving element 102 in the fifth embodiment can be arranged at a higher density than the circular driving element 102 in the first embodiment. That is, the driving element 102 can be arranged in a staggered form, as the driving element 102 has the diamond shape. The shapes of the driving element 102 and the pressure chamber 201 are not limited to a circular shape or a diamond shape, and may be other shapes such as an oval shape or a rectangular shape.

In at least one of the above-described ink jet heads, the insulating layer is disposed between the driving element and the opening. Therefore, various types of inks including a conductive ink may be used in the ink jet head.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the ink jet head 21 may not include the separate plate 300. The ink jet head 21 without the separate plate 300 may discharge ink by adjusting the specifications of the ink jet head 21 and the diameter and depth of the pressure chamber 201.

What is claimed is:

1. An ink jet head comprising:

a pressure chamber formed to hold ink; and a nozzle plate including, a vibrating plate that is made of an inorganic material and has a first surface serving as a bottom wall of the pressure chamber and a second surface opposite the first surface, a first opening that penetrates the vibrating plate and has a first diameter to discharge the ink held in the pressure chamber, a driving element that is provided on the second surface and has a second opening having a second diameter larger than the first diameter to surround the first opening by an inner edge surface thereof and configured to cause a volume of the pressure chamber to be changed by deforming the vibrating plate upon application of voltage to the driving element, an insulating layer that is formed of an inorganic material and covers the driving element and the inner edge surface of the driving element, and a protective layer that is formed of an organic material and covers the insulating layer including a third opening communicating with the first opening.

2. The inkjet head according to claim 1, wherein the first and third openings are formed through the nozzle plate.

3. The inkjet head according to claim 1, wherein the vibrating plate is exposed to the first opening.

4. The inkjet head according to claim 2, wherein the vibrating plate is covered by the insulating layer to not be exposed to the opening.

5. The inkjet head according to claim 4, wherein a hole corresponding to the opening that is formed through the vibrating plate is larger than the opening and portions of the vibrating plate exposed by the hole are covered by the insulating layer.

6. The inkjet head according to claim 1, wherein the nozzle plate further includes an ink repellent layer formed on a surface of the protective layer and having a hole that forms a part of the opening.

7. The inkjet head according to claim 1, wherein the driving element includes a first electrode, a second electrode, and a piezoelectric layer interposed between the first and second electrodes.

8. The inkjet head according to claim 7, wherein the first electrode serves as common electrode and the second electrode serves as a wiring electrode.

9. The inkjet head according to claim 7, wherein the insulating layer includes a hole to connect the second electrode with a wiring electrode while the first and second electrodes are electrically insulated.

10. The inkjet head according to claim 1, wherein the insulating layer is made of $SiO_2$.

11. The inkjet head according to claim 1, wherein the protective layer is made of a positive photosensitive polyimide.

* * * * *